US008434471B2

(12) United States Patent
Jensen

(10) Patent No.: US 8,434,471 B2
(45) Date of Patent: May 7, 2013

(54) INDOOR/OUTDOOR FIREPLACE APPARATUS

(75) Inventor: Seth Jensen, Racine, WI (US)

(73) Assignee: Jensen Metal Products, Inc., Racine, WI (US)

( * ) Notice: Subject to any disclaimer, the term of this patent is extended or adjusted under 35 U.S.C. 154(b) by 217 days.

(21) Appl. No.: 12/856,254

(22) Filed: Aug. 13, 2010

(65) Prior Publication Data

US 2012/0037149 A1 Feb. 16, 2012

(51) Int. Cl.
*F24C 5/00* (2006.01)
*F23Q 2/32* (2006.01)

(52) U.S. Cl.
USPC ..... 126/512; 431/125

(58) Field of Classification Search ..... 126/512; 431/125
See application file for complete search history.

(56) References Cited

U.S. PATENT DOCUMENTS

| | | | | |
|---|---|---|---|---|
| 2,531,828 | A | 11/1950 | Schultz | |
| 3,413,967 | A | 12/1968 | Hoock | |
| 3,006,609 | A | 9/1971 | Lipper et al. | |
| 4,150,610 | A | 4/1979 | Ferrara | |
| 4,573,905 | A | 3/1986 | Meyers | |
| 4,582,478 | A * | 4/1986 | Hilker | 431/125 |
| 4,818,842 | A | 4/1989 | Walty | |
| 4,890,600 | A | 1/1990 | Meyers | |
| 5,026,271 | A * | 6/1991 | Orlov et al. | 431/125 |
| 5,399,084 | A | 3/1995 | McCullough et al. | |
| 5,743,249 | A | 4/1998 | Boekeloo et al. | |
| 5,794,610 | A | 8/1998 | Facchina | |
| 6,095,794 | A * | 8/2000 | Jamieson et al. | 431/125 |
| 6,267,113 | B1 | 7/2001 | Maust et al. | |
| 6,609,514 | B1 | 8/2003 | Bertolas | |
| 7,182,594 | B1 | 2/2007 | Malafouris | |
| 7,287,979 | B2 | 10/2007 | Backes et al. | |
| D569,493 | S | 5/2008 | Weinberger | |
| D583,919 | S | 12/2008 | Backes et al. | |
| 7,458,808 | B2 | 12/2008 | McCarren | |
| 2005/0150487 | A1 | 7/2005 | Weinberger | |
| 2005/0178379 | A1 | 8/2005 | Weinberger | |
| 2005/0227194 | A1 | 10/2005 | Weinberger | |
| 2005/0247302 | A1 | 11/2005 | Weinberger | |
| 2006/0110695 | A1 | 5/2006 | Weinberger | |
| 2006/0157049 | A1 | 7/2006 | Weinberger | |

FOREIGN PATENT DOCUMENTS

DE 102008053473 A1 * 2/2010

* cited by examiner

*Primary Examiner* — Kenneth Rinehart
*Assistant Examiner* — William Corboy
(74) *Attorney, Agent, or Firm* — Jansson Munger McKinley & Shape Ltd.

(57) ABSTRACT

An indoor-outdoor fireplace apparatus including having a base unit which supports a pair of spaced elongate containers for a fuel of the liquid or gel type. In key embodiments, the two elongate fuel containers each have a short horizontal dimension. A shutter carrier slidably rests on the base-unit top and includes a frame to which a pair of elongate shutter plates are secured in spaced positions to cover the elongate fuel containers, such arrangement providing a visually-broad flame field with full on-and-off and adjustment control with a short shutter stroke.

26 Claims, 10 Drawing Sheets

FIG. 8
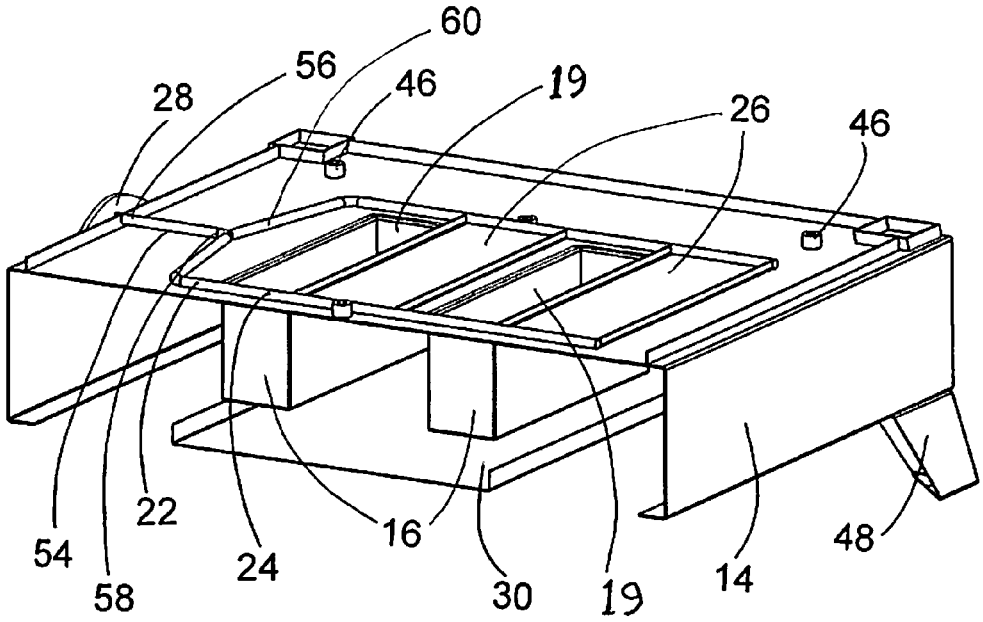
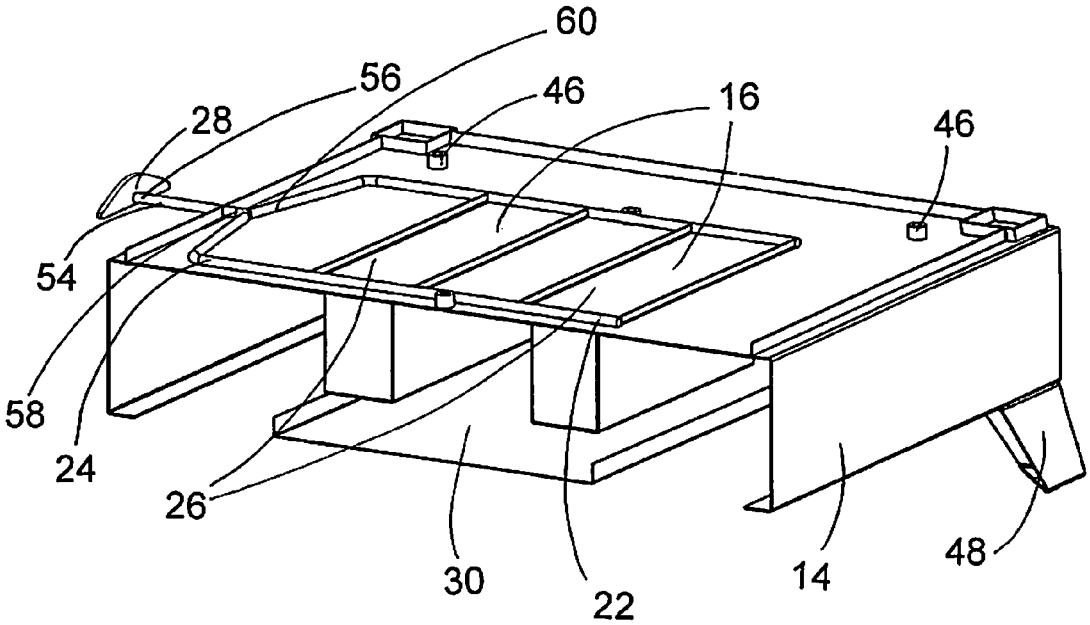
FIG. 9

INDOOR/OUTDOOR FIREPLACE APPARATUS

FIELD OF THE INVENTION

This invention is related generally to fireplace apparatus which utilize gel or liquid fuel and, more specifically, to indoor-outdoor fireplace apparatus which include fuel containers and adjustable shutters to control the flames.

BACKGROUND OF THE INVENTION

So-called "ventless fireplaces," i.e., fireplaces which burn gel or liquid fuel, exist in a variety of forms. Such fireplaces typically have several advantages over various more-traditional fireplaces in that ventless fireplaces cleanly burn their fuel, are often portable, and may not require installation. Typically, it is advantageous for a ventless fireplace to include some sort of shutter mechanism to control the flame. Shutter mechanisms are often controlled through the use of a handle, and this allows the user both to control the flame and to safely extinguish the flame when desired.

Shutter mechanisms for indoor-outdoor fireplaces of the prior art typically have certain disadvantages. Shutters are often located near the combustion chamber and the user must slide a handle across a lid or top wall to close the shutter, a step which often requires the user to place his or her hand close to the open flame. This is a dangerous practice. One example of such a prior art device is disclosed in U.S. Pat. No. 7,287,979 (Backes et al.).

For fairly large indoor-outdoor fireplaces, it is desirable to have a visually-large flame—or at least to have a horizontal flame region which has both a substantial width dimension (i.e., across the front of the fireplace) and a substantial depth dimension (i.e., from the front toward the back of the fireplace). With substantial horizontal dimensions, moving a shutter to control the flame region—i.e., to turn it on and off and to adjust the amount of flame—requires a substantial shutter stroke, and this in turn imposes a number of problems for the shutter-control handle.

It would be desirable to have an indoor-outdoor gel or liquid fuel fireplace apparatus that provides excellent shutter control for large two-dimensional flame region without a commensurately large shutter stroke. It would also be desirable to provide such advantage in a indoor-outdoor fireplace that keeps the shutter-control handle reasonably close to the body of the fireplace apparatus, but without the user having to place his or her hand too close to the flame region. Furthermore, it would be desirable to have an improved indoor-outdoor fireplace apparatus which allows easy short-stroke shutter operation to control a visually-large flame area while avoiding any problems related to jamming of the shutter apparatus.

This invention overcomes certain problems and shortcomings in the prior art, including those mentioned above and others, and provides advantages for indoor/outdoor fireplaces not previously provided.

SUMMARY OF THE INVENTION

This invention is an improvement in indoor-outdoor fireplace apparatuses of the type including a housing, a base unit within the housing, and a container for a fuel of the liquid or gel type supported by the base unit. In the invention, the base unit has a top adapted to receive a pair of removable elongate fuel containers in spaced parallel relationship to one other. The two elongate fuel containers are received in the base-unit top and each fuel container has a short dimension. A shutter carrier slidably rests on the base-unit top and includes a frame to which a pair of shutter plates are secured in spaced positions to cover the elongate fuel containers. The frame has a handle which is positioned outside housing for moving the frame to position the shutters. By use of the spaced pair of fuel containers of the configuration described, a visually-broad flame field is created without a large burning surface. And, full off-and-on control of the flame is provided with a shutter stroke which is substantially as short as the short dimension of the elongate fuel containers.

In a highly preferred embodiment, the spacing between the shutters is at least about the width of the short dimension of the fuel containers. Preferably, a bottom plate is secured beneath the base unit for catching drips and overspills from fueling errors. It is preferred that the housing includes support-corner-bars to which transparent panels are secured.

It is most preferred that the shutter carrier and shutter plates be configured such that movement of the handle to a rest position against the housing results in open fuel containers and movement away from the housing results in closed fuel containers.

Preferred embodiments include an overplate which is above the shutter carrier and is secured to the base-unit top, such overplate providing a surface for holding non-burning, decorative, flame-contact objects, such as rocks or artificial logs. The overplate defines a pair of access openings through which the containers can be inserted for their insertion into a pair of fuel-container openings in the base-unit top defines, where they are engaged and held. The access openings in the overplate are aligned with the fuel-container openings in the base-unit top. A set of first threaded attachment devices (e.g., nuts) are welded on the base-unit top and positioned for securing the overplate to the base unit by a second set of mating threaded attachment devices (e.g., bolts) which extend through holes in the overplate that are aligned with the first threaded attachment devices. The positioning of the first set of threaded attachment devices preferably serves the further purpose of guiding/positioning the shutter carrier over the base-unit top, and the assembled overplate and base unit provide space for the shutter carrier and operation thereof.

Preferably the frame of the shutter carrier includes a stem portion having a distal end with the handle and at the proximal end a rod transverse to the stem. It is highly preferred that the overplate include a downward flange with a notch for slidingly receiving the stem portion. Preferably, the flange portion is positioned to engage the transverse portion of the rod thereby to position the shutter carrier.

In some preferred embodiments, a stiffener feature is located between the pair of access openings. Preferably, the stiffener feature includes an embossed rib to prevent shutter-carrier binding.

In one embodiment, the indoor-outdoor fireplace apparatus has three spaced fuel containers and a corresponding three spaced shutter plates. Another aspect of the invention is the structure of the indoor-outdoor fireplace apparatus as relates to the shutter, but without respect to whether there are one or more fuel containers and a corresponding number of shutter plates.

BRIEF DESCRIPTION OF THE DRAWINGS

The drawings illustrate a preferred embodiment including the above-noted characteristics and features of the device. The device will be readily understood from the descriptions and drawings. In the drawings:

FIG. 8 is a cut-away view of the base and bottom plate of FIG. 1 illustrating the shutter in the open position.

FIG. 9 is a cut-away view of the base and bottom plate of FIG. 1 illustrating the shutter in the closed position.

DETAILED DESCRIPTION OF PREFERRED EMBODIMENTS

Figure 1:
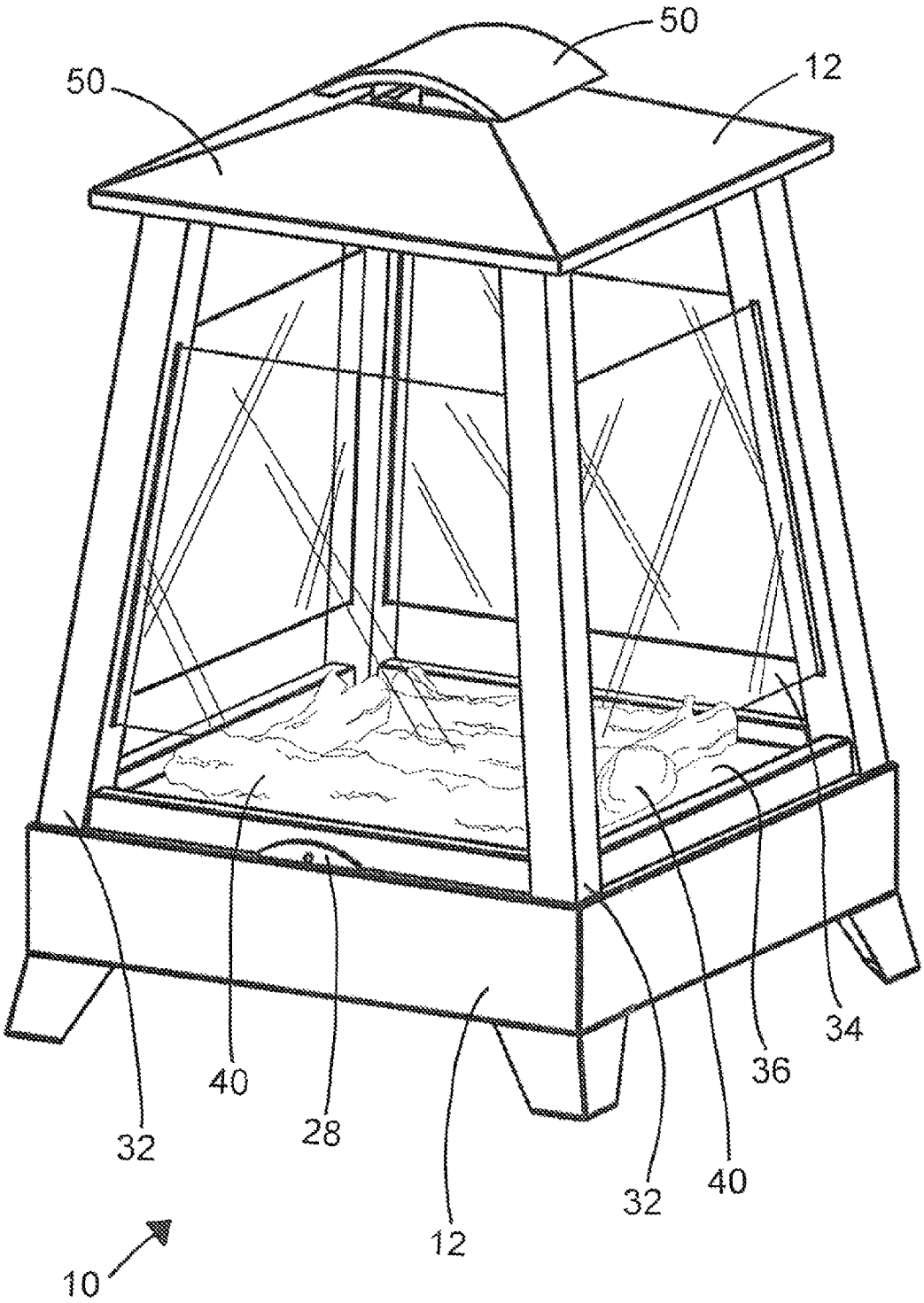
FIG. 1 is a perspective view of an indoor-outdoor fireplace in accordance with this invention.
Figure 2:
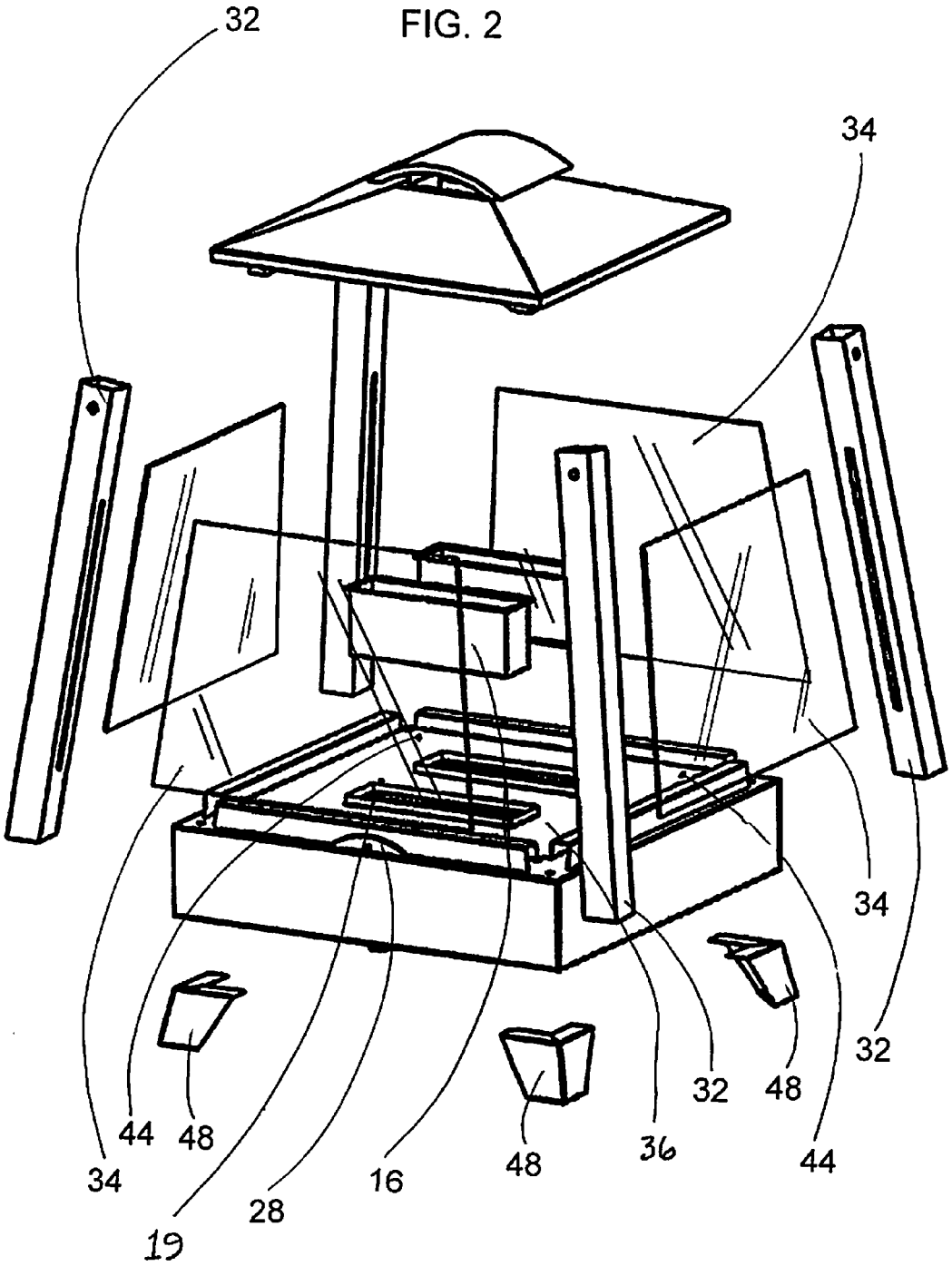
FIG. 2 is an exploded perspective view of the apparatus of FIG. 1.

FIGS. 1-11 and 13A-13C illustrate a preferred embodiment of an indoor-outdoor fireplace apparatus 10. Apparatus 10 includes a housing 12 and a base unit 14 within housing 12 near the lower end thereof. Base unit 14 supports a pair of elongate fuel containers 16 for a fuel of the liquid or gel type. Base unit 14 has a top 18 with fuel-container openings 19 adapted to receive removable fuel containers 16 in spaced parallel relationship to one other. Elongate fuel containers 16 are received in base-unit top 18 and each fuel container 16 has a wide horizontal dimension and a short horizontal dimension 20. This two-chamber approach gives a flame field which is visually-broad in two horizontal dimensions, but without a similarly large fuel-burning surface.

Figure 11:
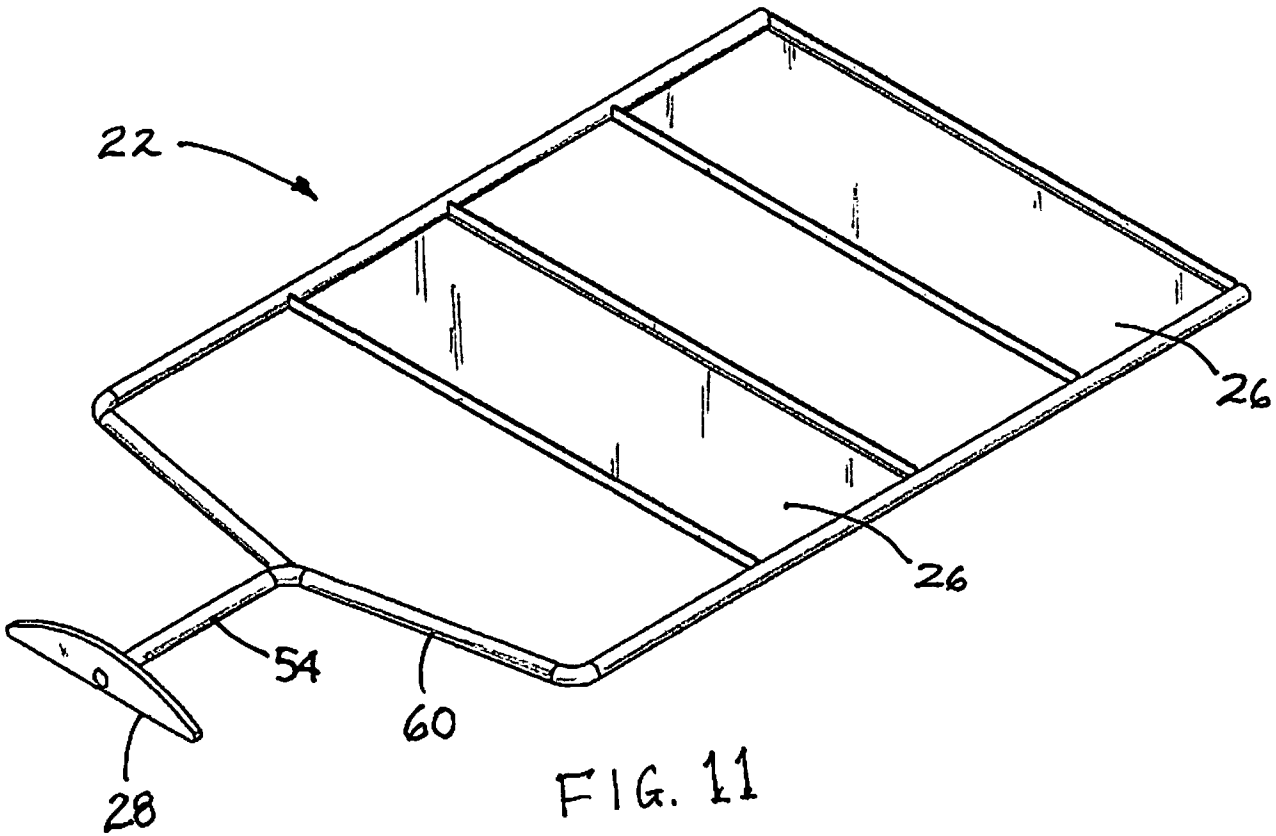
FIG. 11 is a perspective view of the shutter carrier of the apparatus of FIG. 1.
Figure 13A:
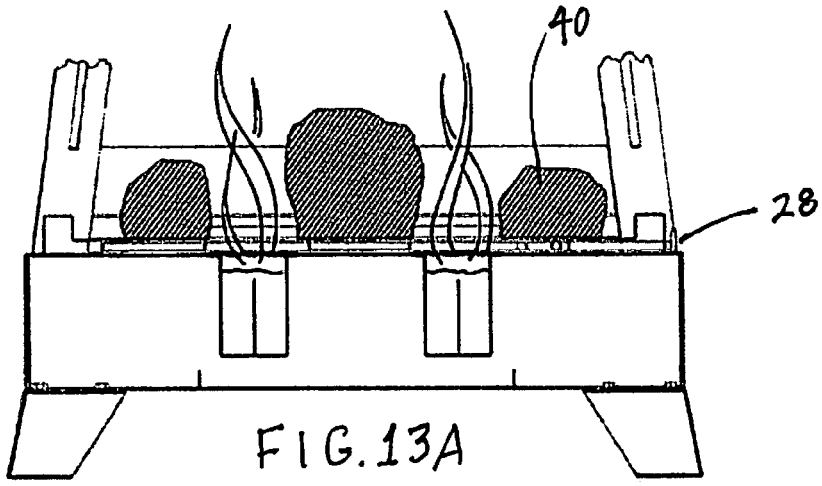
FIGS. 13A-13C are fragmentary side elevations of the device of FIGS. 1-11.
Figure 13B:
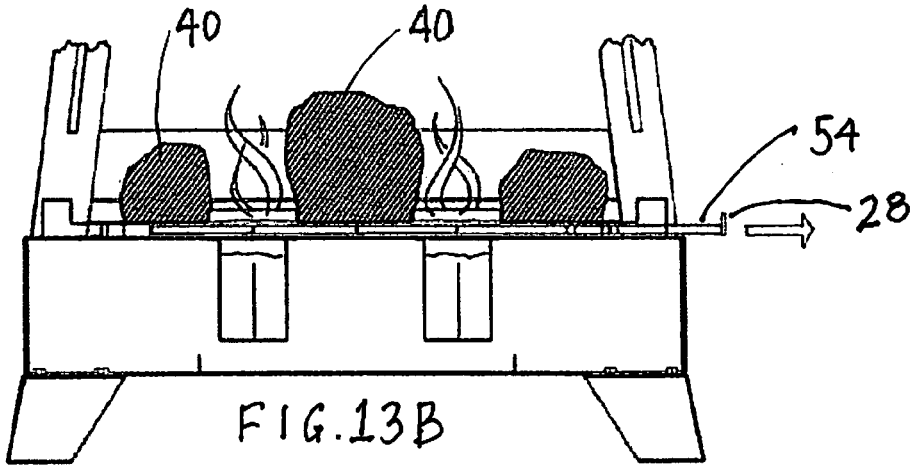
Figure 13C:
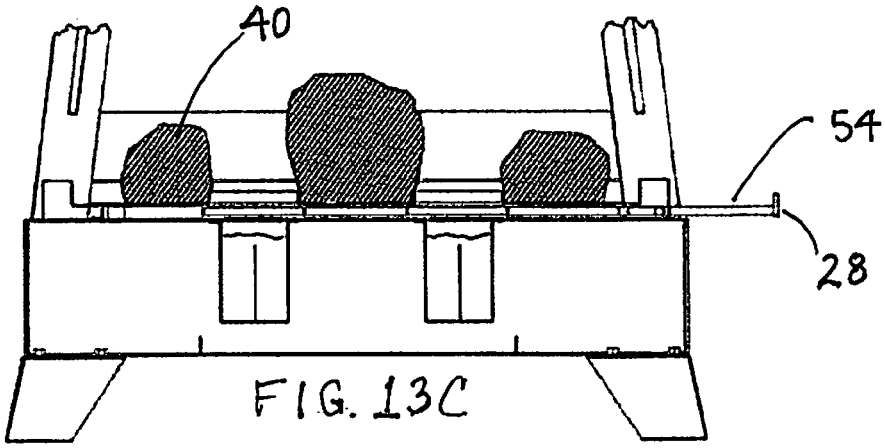

A shutter carrier 22 slidably rests on base-unit top 18 and includes a frame 24 to which a pair of shutter plates 26 are secured in spaced positions to cover elongate fuel containers 16. Frame 24 has a handle 28 positioned outside housing 12 for moving frame 24 to position shutters 26. The visually-broad flame field is fully controlled, i.e., with both full off-and-on control and full adjustment of the extent of the flame size, by use of a shutter stroke that is substantially less than the total front-to-back dimension of the pair of fuel containers 16 in base unit 14. The full "on" position is illustrated by FIG. 13A and the full "off" position is illustrated by FIG. 13C, while FIG. 13B illustrates a reduced "on" position. It can be seen that handle 28 has moved shutter carrier 22 to these positions. As illustrated in FIGS. 8-9 and 11, the spacing between shutter plates 26 is at least about the width of short dimension 20 of fuel containers 16.

Figure 10:
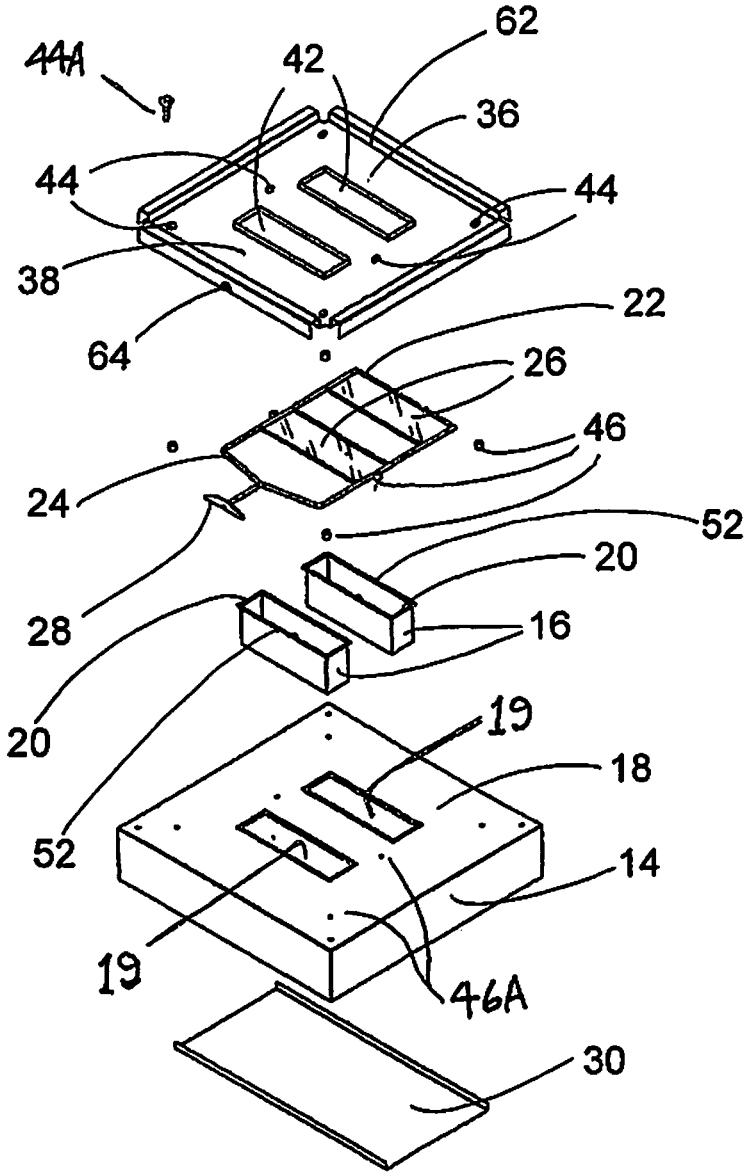
FIG. 10 is an exploded view of portions of the apparatus of FIG. 1

As shown in FIGS. 8-10, a bottom plate 30 is secured beneath base unit 14 for catching drips and overspills from fueling errors.

Figure 3:
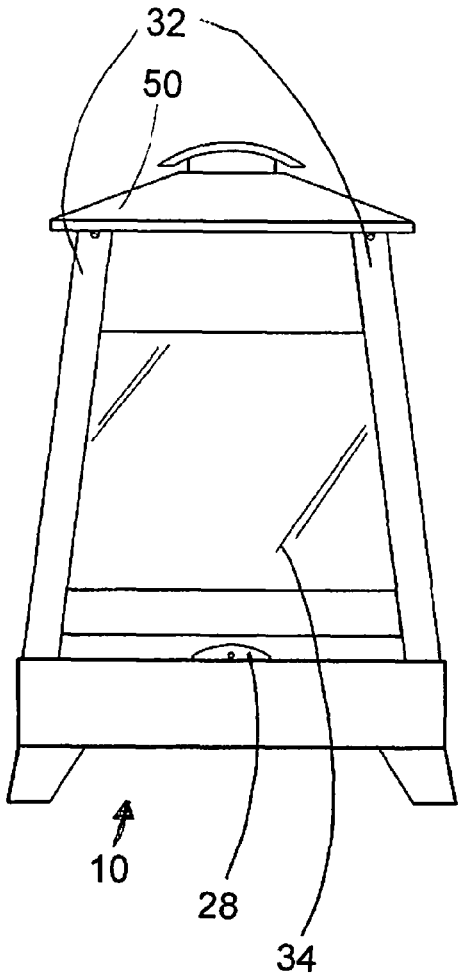
FIG. 3 is a front view of the apparatus of FIG. 1.
Figure 4:
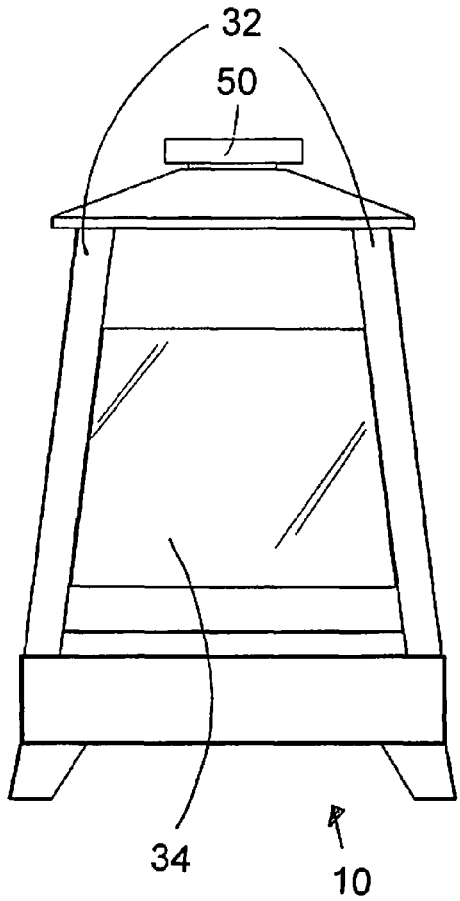
FIG. 4 is a side view of the apparatus of FIG. 1.
Figure 5:
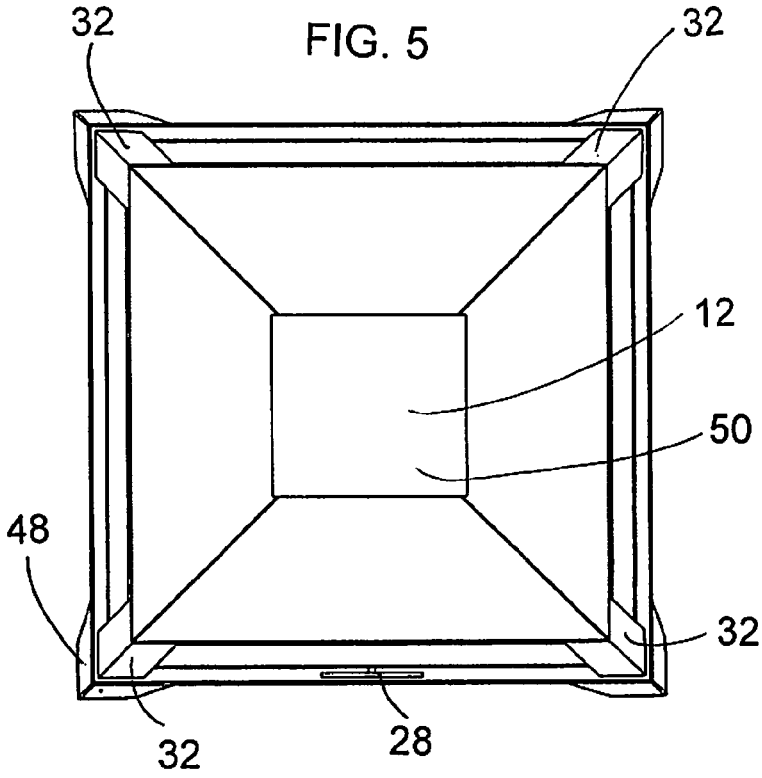
FIG. 5 is a top view of the apparatus of FIG. 1.
Figure 6:
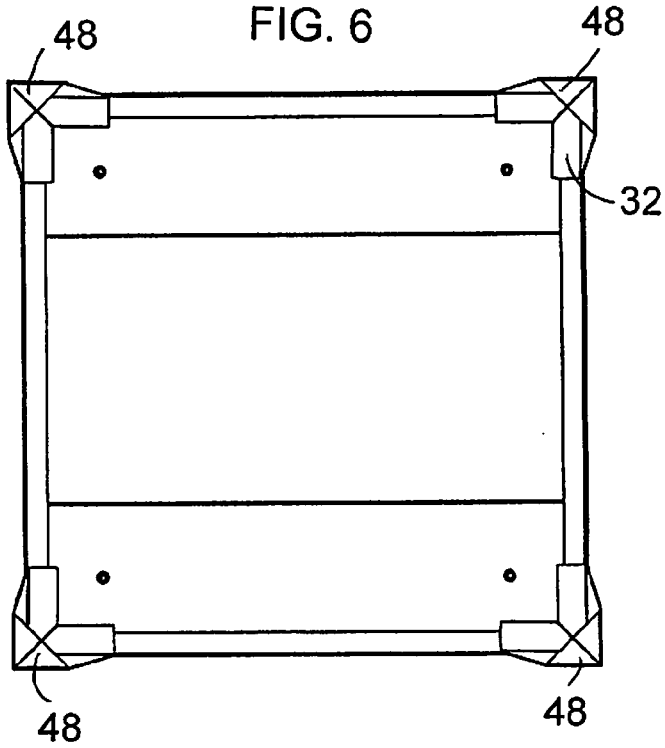
FIG. 6 is a bottom view of the apparatus of FIG. 1.

FIGS. 1 and 3-4 illustrate that housing 12 includes four support-corner-bars 32 to which transparent panels 34 are secured. Transparent panels 34 can be made of glass or a similar transparent flame-resistant material. Support-corner-bars 32 give indoor-outdoor fireplace apparatus 10 overall strength and structure. FIGS. 5-6 illustrate the relationship of support-corner-bars 32 with housing 12 and feet 48. As seen in FIGS. 1 and 3-5, housing 12 includes a cap 50 which allows smoke or other elements to escape from the interior of indoor-outdoor fireplace apparatus 10 and helps protect the interior of indoor-outdoor fireplace apparatus 10 from inclement weather.

Figure 7:
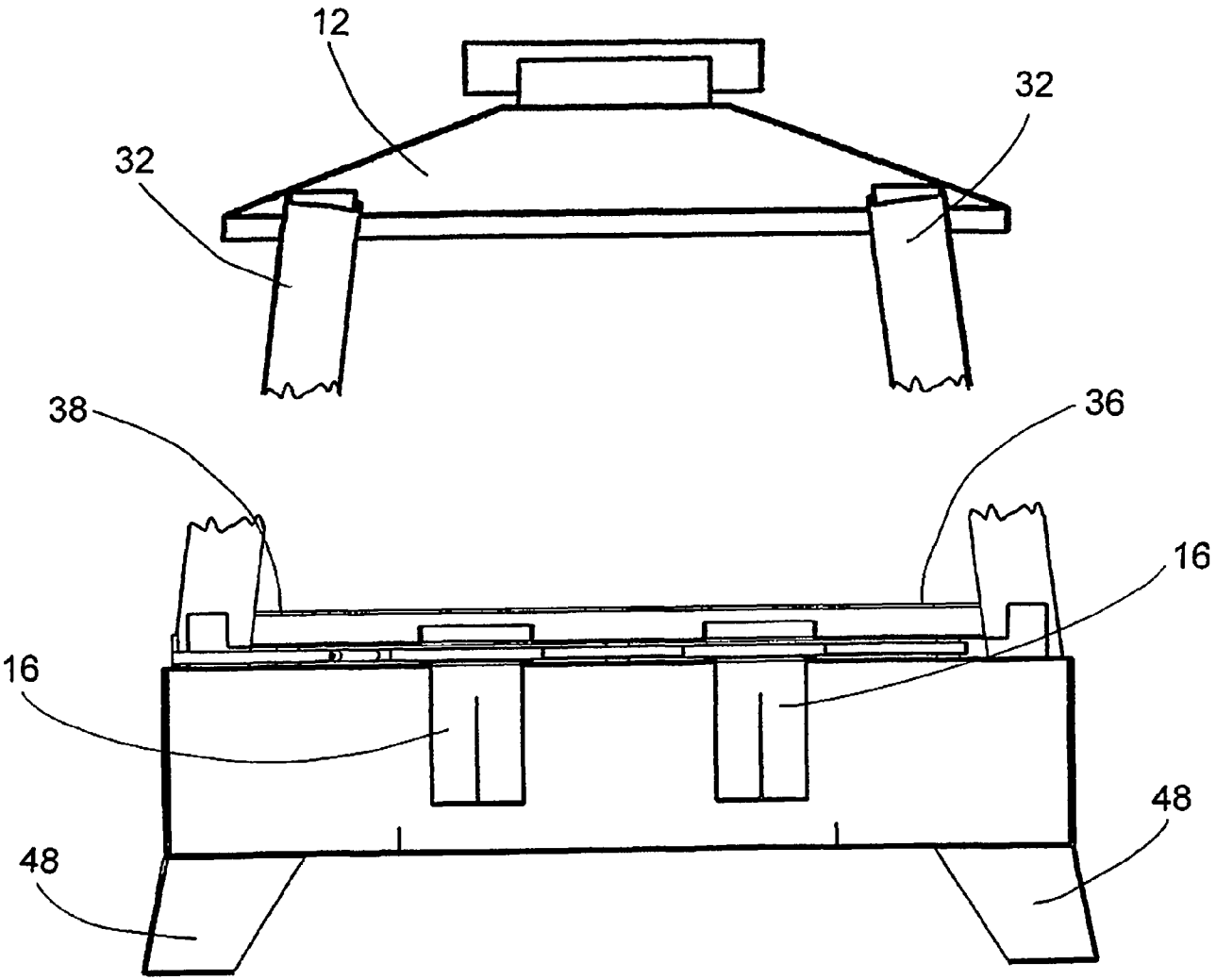
FIG. 7 is a side cut-away view of the apparatus of FIG. 1 illustrating the removable fuel containers inserted into the base.

FIG. 7 is a side cut-away view which shows that fuel containers 16 are received in base-unit top 18 and base unit 14. As seen in FIG. 10 and mentioned above, each fuel container 16 has a short dimension 20; its other horizontal dimension is a long dimension 52. While the plan view (view from above) of fuel containers 16 is generally rectangular, variations in such shape are possible as long as it has long and short horizontal dimensions.

FIGS. 8-9 illustrate that shutter carrier 22 and shutter plates 26 are configured such that movement of handle 28 to a rest position against housing 12 results in open fuel containers 16 and movement away from housing 12 results in closed fuel containers 16. This enables the opening and closing of shutter plates 26 to be safe since the user does not need to get his or her hand close to the flame.

Frame 24 of shutter carrier 22 includes a stem portion 54 having a distal end 56 with handle 28 and at the proximal end 58 a rod portion 60 which is transverse to the stem portion 54. FIG. 10 shows that an overplate 36, which is above shutter carrier 22 and is secured to base-unit top 18, includes a downward flange 62 with a notch 64 in it for slidingly receiving stem portion 54. Flange portion 62 is positioned to engage transverse rod portion 60 to position shutter carrier 22 in the closed (flame-off) position. Transverse rod portion 60 engages notch 64 for further guiding and positioning of shutter carrier 22.

Overplate 36 has a pair of access openings 42 which are aligned with respective fuel-container openings 19 in base-unit top 18 and serve to allow containers 16 to be inserted through overplate 36 and into for engagement with base-unit top 18, when shutter carrier 22 is in its open position. A stiffener feature (not shown) may be located in overplate 36 in a position between the pair of access openings 42. Such stiffener feature is preferably an embossed rib to prevent heat warping of overplate 36 and thus avoid any binding of shutter carrier 22 in its position between overplate 36 and base-unit top 18.

As seen best in FIGS. 1 and 13A-13C, overplate 36 provides a surface for holding non-burning, decorative, flame-contact objects 40. As is well known, suitable non-burning, decorative, flame-contact objects can be logs, rocks or the like.

The assembly of overplate 36 with base-unit top 18, with shutter carrier 22 therebetween, is illustrated best in FIGS. 8-10. FIGS. 8 and 9 show that base-unit top 18 has a set of nuts 46 welded thereon in alignment with openings 46A in base-unit top, as shown in FIG. 10. Overplate 36 has corresponding aligned holes 44 through which bolts 44A (only one of which is illustrated) extend into threaded engagement with respective nuts 46, to hold overplate is fixed position with respect to base unit 14 and base-unit top 18. The positioning of nuts 44 serves the further purpose of guiding/positioning shutter carrier 22 over base-unit top 18. This securement of overplate 36 to base unit 14 provides a space for shutter carrier 22 to move to control the flame.

Figure 12:
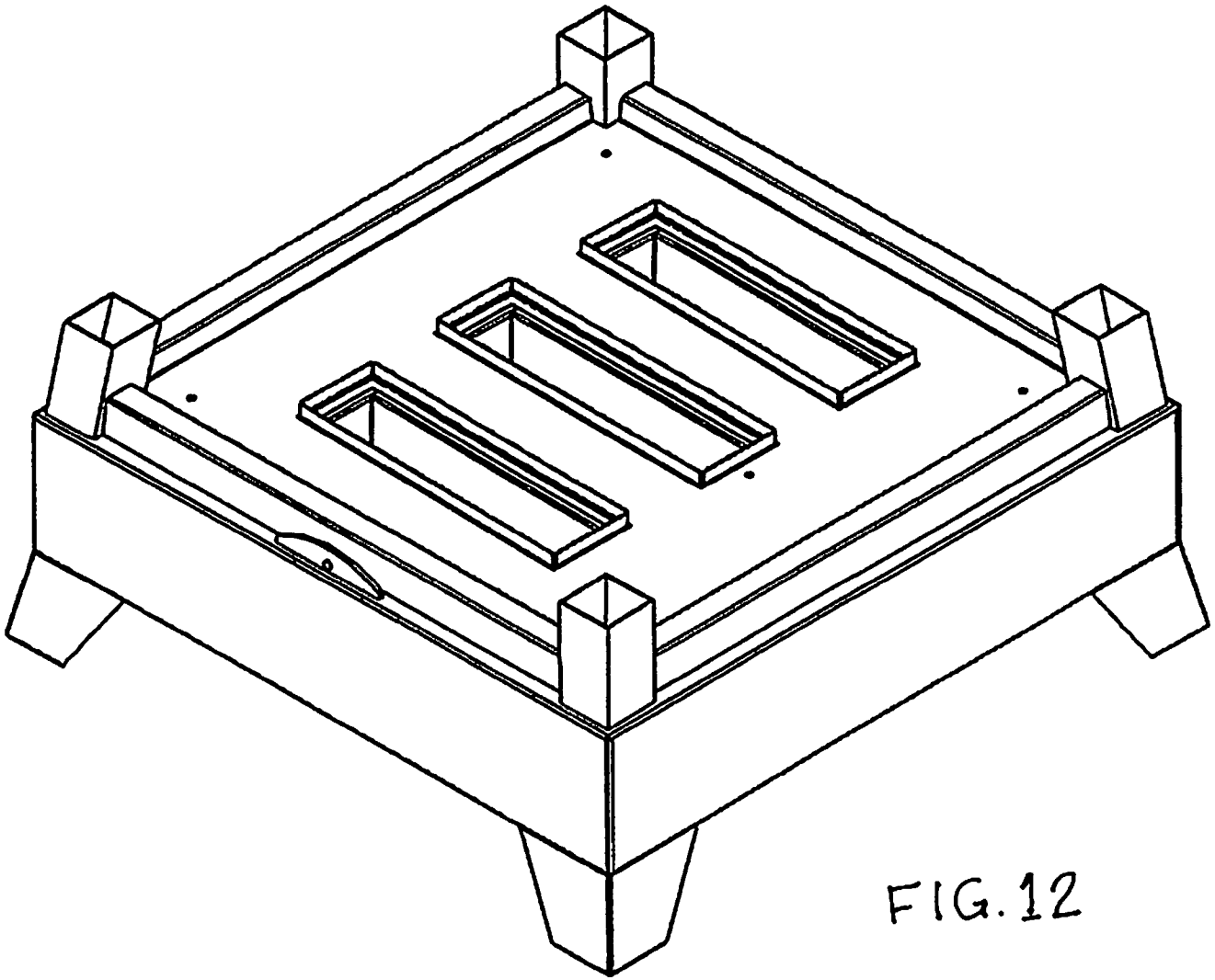
FIG. 12 is a fragmentary schematic view of an alternate embodiment of the apparatus of FIG. 1 having three fuel containers.

FIG. 12 illustrates an alternative embodiment which has three, rather than two, spaced fuel containers. Such embodiment has a shutter carrier with three, rather than two, spaced shutter plates 26. As with the embodiment illustrated in FIGS. 1-11 and 13A-13C, a large flame area is provided and is fully controlled with a shutter device having a considerably reduced stroke than would be possible without the use of key concepts of this invention.

A wide variety of materials are available for the various parts discussed and illustrated herein. Housing 12 is a metal fabrication, and is preferably formed of powder-coated steel, stainless steel or the like. Various types of liquid or gel fuel can be used. For example, isopropanol and ethanol, each either in a liquid or gel fuel form, can be used. Fuel container 16 can be filled by a pour-in fuel or by replacement fuel cartridges.

While the principles of this invention have been described in connection with specific embodiments, it should be understood clearly that these descriptions are made only by way of example and are not intended to limit the scope of the invention.

The invention claimed is:

1. In an indoor-outdoor fireplace apparatus including a housing, a base unit within the housing near the lower end thereof, and at least one container for a fuel of the liquid or gel type supported by the base unit, the improvement comprising:

the at least one container being a pair of elongate fuel containers, each having a short dimension;

the base unit having a top defining a pair of fuel-container openings therethrough in spaced substantially parallel relationship to one another and adapted to removably receive and engage the elongate fuel containers;

a shutter carrier slidably resting on the base-unit top and including a frame to which a pair of shutter plates are secured in spaced positions to cover the elongate fuel containers, the frame having a handle positioned outside the housing for moving the frame to position the shutters;

an overplate above the shutter carrier and secured to the base-unit top, such overplate providing a surface for holding non-burning, decorative, flame-contact objects, the overplate defining a pair of access openings therethrough for passage of the fuel containers therethrough to their position received within the fuel-container openings in the base-unit top; and a set of first threaded attachment devices welded on the base-unit top and positioned for securing the overplate to the base unit by a second set of mating threaded attachment devices, the positioning of the first set of threaded attachment devices serving the further purpose of guiding and positioning the shutter carrier over the base-unit top, whereby a visually-broad flame field is created without a large burning surface and full off-and-on control of the flame is provided with a shutter stroke substantially less than the dimension across the pair of fuel containers in the base unit.

2. The indoor-outdoor fireplace apparatus of claim 1 wherein the spacing between the shutters is at least about the width of the short dimension of the fuel containers.

3. The indoor-outdoor fireplace apparatus of claim 1 wherein a bottom plate is secured beneath the base unit for catching drips and overspills from fueling errors.

4. The indoor-outdoor fireplace apparatus of claim 1 wherein the housing includes support-corner-bars to which transparent panels are secured.

5. The indoor-outdoor fireplace apparatus of claim 1 wherein the shutter carrier and shutter plates are configured such that movement of the handle to a rest position against the housing results in open fuel containers and movement away from the housing results in closed fuel containers.

6. The indoor-outdoor fireplace apparatus of claim 1 wherein the frame of the shutter carrier includes a stem portion having a distal end with the handle and at the proximal end a rod transverse to the stem.

7. The indoor-outdoor fireplace apparatus of claim 6 wherein the overplate includes a downward flange with a notch for slidingly receiving the stem portion, the flange portion positioned to engage the transverse portion of the rod thereby to position the shutter carrier.

8. The indoor-outdoor fireplace apparatus of claim 1 wherein there are three spaced fuel containers and a corresponding set of three spaced shutter plates.

9. The indoor-outdoor fireplace apparatus of claim 1 wherein the overplate has a stiffener feature at a position between the pair of access openings.

10. The indoor-outdoor fireplace apparatus of claim 9 wherein the stiffener feature is an embossed rib to prevent shutter carrier binding.

11. In an indoor-outdoor fireplace apparatus including a housing, a base unit within the housing near the lower end thereof, and a container for a fuel of the liquid or gel type supported by the base unit, the improvement comprising:

the fuel container being an elongate fuel container having a short dimension;

the base unit having a top defining a fuel container opening therethrough and adapted to removably receive the elongate fuel container;

a shutter carrier slidably resting on the base-unit top and including a frame to which a shutter plate is secured to cover the elongate fuel container, the frame having a handle positioned outside the housing for moving the frame to position the shutter;

an overplate above the shutter carrier and secured to the base-unit top, such overplate defining an access opening for passage of the fuel container therethrough to its position received within the fuel container opening in the base-unit top, such overplate providing a surface for holding non-burning, decorative, flame-contact objects; and a set of first threaded attachment devices welded on the base-unit top and positioned for securing the overplate to the base unit by a second set of mating threaded attachment devices, the positioning of the first set of threaded attachment devices serving the further purpose of guiding and positioning the shutter carrier over the base-unit top, whereby a visually-broad flame field is created without a large burning surface and full off-and-on control of the flame is provided with a shutter stroke substantially similar to the short dimension of the fuel container.

12. The indoor-outdoor fireplace apparatus of claim 11 wherein a bottom plate is secured beneath the base unit for catching drips and overspills from fueling errors.

13. The indoor-outdoor fireplace apparatus of claim 11 wherein the housing includes support-corner-bars to which transparent panels are secured.

14. The indoor-outdoor fireplace apparatus of claim 11 wherein the shutter carrier and shutter plate are configured such that movement of the handle to a rest position against the housing results in an open fuel container and movement away from the housing results in a closed fuel container.

15. The indoor-outdoor fireplace apparatus of claim 11 wherein the frame of the shutter carrier includes a stem portion having a distal end with the handle and at the proximal end a rod transverse to the stem.

16. The indoor-outdoor fireplace apparatus of claim 11 wherein the overplate includes a downward flange with a notch for slidingly receiving the stem portion, the flange portion positioned to engage the transverse portion of the rod thereby to position the shutter carrier.

17. In an indoor-outdoor fireplace apparatus including a housing, a base unit within the housing near the lower end thereof, and at least one container for a fuel of the liquid or gel type supported by the base unit, the improvement comprising:

the at least one container being a pair of elongate fuel containers, each having a short dimension;

the base unit having a top defining a pair of fuel-container openings therethrough in spaced substantially parallel relationship to one another and adapted to removably receive the elongate fuel containers;

a shutter carrier slidably resting on the base-unit top and including a frame to which a pair of shutter plates are secured in spaced positions to cover the elongate fuel containers, the frame having a handle positioned outside the housing for moving the frame to position the shutters;

an overplate above the shutter carrier and secured to the base-unit top, such overplate defining a pair of access openings for passage of the fuel containers therethrough to their positions received within the fuel container openings in the base-unit top, such overplate providing a surface for holding non-burning, decorative, flame-contact objects; and a set of first threaded attachment devices welded on the base-unit top and positioned for securing the overplate to the base unit by a second set of mating threaded attachment devices, the positioning of the first set of threaded attachment devices serving the further purpose of guiding and positioning the shutter carrier over the base-unit top, whereby a visually-broad flame field is created without a large burning surface and full off-and-on control of the flame is provided with a shutter stroke substantially less than the dimension across the pair of fuel containers in the base unit.

18. The indoor-outdoor fireplace apparatus of claim 17 wherein the spacing between the shutters is at least about the width of the short dimension of the fuel containers.

19. The indoor-outdoor fireplace apparatus of claim 17 wherein a bottom plate is secured beneath the base unit for catching drips and overspills from fueling errors.

20. The indoor-outdoor fireplace apparatus of claim 17 wherein the housing includes support-corner-bars to which transparent panels are secured.

21. The indoor-outdoor fireplace apparatus of claim 17 wherein the shutter carrier and shutter plates are configured such that movement of the handle to a rest position against the housing results in open fuel containers and movement away from the housing results in closed fuel containers.

22. The indoor-outdoor fireplace apparatus of claim 17 wherein the overplate has a stiffener feature at a position between the pair of access openings.

23. The indoor-outdoor fireplace apparatus of claim 22 wherein the stiffener feature is an embossed rib to prevent shutter carrier binding.

24. The indoor-outdoor fireplace apparatus of claim 17 wherein the frame of the shutter carrier includes a stem portion having a distal end with the handle and at the proximal end a rod transverse to the stem.

25. The indoor-outdoor fireplace apparatus of claim 24 wherein the overplate includes a downward flange with a notch for slidingly receiving the stem portion, the flange portion positioned to engage the transverse portion of the rod thereby to position the shutter carrier.

26. The indoor-outdoor fireplace apparatus of claim 17 wherein there are three spaced fuel containers and a corresponding set of three spaced shutter plates.

* * * * *